US011222777B2

(12) United States Patent
Kaposi et al.

(10) Patent No.: US 11,222,777 B2
(45) Date of Patent: Jan. 11, 2022

(54) ION GUIDE COMPRISING ELECTRODE WIRES AND ION BEAM DEPOSITION SYSTEM

(71) Applicant: Technische Universität München, Munich (DE)

(72) Inventors: Tobias Kaposi, Landsberg am Lech (DE); Hartmut Schlichting, Gilching (DE); Johannes Barth, Garching (DE); Andreas Walz, Munich (DE)

(73) Assignee: TECHNISCHE UNIVERSITÄT MÜNCHEN, Munich (DE)

( * ) Notice: Subject to any disclaimer, the term of this patent is extended or adjusted under 35 U.S.C. 154(b) by 0 days.

(21) Appl. No.: 17/045,420

(22) PCT Filed: Apr. 5, 2019

(86) PCT No.: PCT/EP2019/058679
§ 371 (c)(1),
(2) Date: Oct. 5, 2020

(87) PCT Pub. No.: WO2019/193171
PCT Pub. Date: Oct. 10, 2019

(65) Prior Publication Data

US 2021/0159064 A1 May 27, 2021

(30) Foreign Application Priority Data

Apr. 5, 2018 (EP) ..... 18165948
Apr. 5, 2018 (EP) ..... 18165949
Apr. 5, 2018 (EP) ..... 18165950

(51) Int. Cl.
*H01J 49/06* (2006.01)
*H01J 49/00* (2006.01)
(Continued)

(52) U.S. Cl.
CPC ..... *H01J 49/066* (2013.01); *H01J 49/0031* (2013.01); *H01J 49/022* (2013.01);
(Continued)

(58) Field of Classification Search
CPC .... H01J 49/066; H01J 49/0031; H01J 49/022; H01J 49/063; H01J 49/068; H01J 49/065;
(Continued)

(56) References Cited

U.S. PATENT DOCUMENTS 3,867,632 A 2/1975 Fite
3,936,634 A 2/1976 Fite
(Continued)

FOREIGN PATENT DOCUMENTS

GB 2416913 A 2/2006
RU 817801 2/2006
(Continued)

OTHER PUBLICATIONS

MassTech: "Two Stage Ion Funnel for Thermo Mass Spectrometers; Installation, Operation, and Maintenance Manual", Oct. 12, 2017.
(Continued)

*Primary Examiner* — Kiet T Nguyen
(74) *Attorney, Agent, or Firm* — Steven J. Grossman; Grossman, Tucker, Perreault & Pfleger PLLC

(57) ABSTRACT

Disclosed herein is an ion guide for guiding an ion beam along an ion path, said ion guide having a longitudinal axis corresponding to said ion path, said ion guide-comprising a plurality of elongate electrodes arranged around and extending along said longitudinal axis wherein an inner envelope of the plurality of electrodes defines an ion guide volume. Said elongate electrodes are formed by electrode wires, wherein adjacent electrode wires are arranged at an inter-wire distance. The ion guide comprises holding structures for supporting and for straightening the electrode wires by
(Continued)

applying a tension or maintaining a tension applied to them. Any portion of said holding structures which is separated from said ion guide volume by less than the local inter-wire distance is made from a material having a resistivity of less than $10^{12}$ Ohm·cm, preferably of less than $10^{9}$ Ohm·cm, or has a sheet resistivity of less than $10^{14}$ Ohm, preferably of less than $10^{10}$ Ohm on a surface facing said ion guide volume.

18 Claims, 11 Drawing Sheets

(51) Int. Cl.
*H01J 49/02* (2006.01)
*H01J 49/42* (2006.01)

(52) U.S. Cl.
CPC ..... *H01J 49/063* (2013.01); *H01J 49/068* (2013.01); *H01J 49/4215* (2013.01); *H01J 49/4225* (2013.01); *H01J 49/4255* (2013.01)

(58) Field of Classification Search
CPC . H01J 49/4215; H01J 49/4225; H01J 49/4255
USPC ..... 250/292, 290
See application file for complete search history.

(56) References Cited

U.S. PATENT DOCUMENTS

| | | | | |
|---|---|---|---|---|
| 3,937,954 | A | 2/1976 | Fite | |
| 4,013,887 | A | 3/1977 | Fite | |
| 4,283,626 | A | 8/1981 | Siegel | |
| 4,814,613 | A | 3/1989 | Fite et al. | |
| 4,885,500 | A | 12/1989 | Hansen et al. | |
| 5,652,427 | A | 7/1997 | Whitehouse et al. | |
| 6,441,370 | B1 | 8/2002 | Khosla et al. | |
| 7,582,861 | B2 | 9/2009 | Mukaibatake | |
| 7,595,486 | B2 | 9/2009 | Franzen | |
| 8,003,938 | B2 | 8/2011 | Brekenfeld | |
| 8,822,918 | B2 | 9/2014 | Taniguchi | |
| 9,287,103 | B2 | 3/2016 | Baba | |
| 2003/0136905 | A1 | 7/2003 | Franzen et al. | |
| 2003/0157269 | A1 | 8/2003 | Ratner et al. | |
| 2003/0178564 | A1 | 9/2003 | Kernan et al. | |
| 2004/0051038 | A1 | 3/2004 | Taniguchi | |
| 2005/0258364 | A1* | 11/2005 | Whitehouse ..... | H01J 49/062 250/292 |
| 2006/0108520 | A1 | 5/2006 | Park et al. | |
| 2010/0102221 | A1 | 4/2010 | Brekenfeld | |
| 2010/0301210 | A1 | 12/2010 | Bertsch et al. | |
| 2011/0101220 | A1* | 5/2011 | Syms ..... | H01J 49/0018 250/290 |
| 2013/0187044 | A1* | 7/2013 | Ding ..... | H01J 49/065 250/292 |
| 2014/0361163 | A1 | 12/2014 | Taniguchi et al. | |
| 2014/0374589 | A1 | 12/2014 | Javaheri et al. | |
| 2016/0035556 | A1 | 2/2016 | Berkout et al. | |
| 2016/0133452 | A1* | 5/2016 | Bertsch ..... | H01J 49/063 250/292 |
| 2016/0322209 | A1 | 11/2016 | Wouters et al. | |
| 2017/0350860 | A1 | 12/2017 | Rather et al. | |

FOREIGN PATENT DOCUMENTS

| | | |
|---|---|---|
| WO | 2005114705 | 1/2006 |
| WO | 19950023018 | 2/2006 |
| WO | 2013124364 | 8/2013 |
| WO | 201457345 | 4/2014 |
| WO | 2001013100 | 2/2020 |

OTHER PUBLICATIONS

International Journal of Mass Spectrometry and Ion Physics, "A New Operating Mode for the Quadrupole Mass Filter" (1973) pp. 317-339.

Guzowski, J., et al., "Characteristics of a rf-only hexapole ion-guide interface for plasmasource time-of-flight mass spectrometry," J. Anal. At. Spectrom, 2001, 16, pp. 781-792.

von Zahn, U. Präzisions-Massenbestimmungen mit dem elektrischen Massenfilter. Z. Physik 168, 129-142 (1962). (absract in English only).

* cited by examiner

ION GUIDE COMPRISING ELECTRODE WIRES AND ION BEAM DEPOSITION SYSTEM

BACKGROUND

Ion beams have many uses in various fields of natural sciences and technology, including experimental physics, medical devices, electronic components manufacturing or life science, in particular mass spectroscopy, where electrically charged molecules (ions) are guided to, from or within a mass spectrometer or a collision cell. The general purpose of an ion guide is to confine an ion beam along its predetermined path, typically using a plurality of electrodes arranged around the ion path, which in combination generate an electrical potential guiding the ions. In the simplest case, the potential could be a static DC potential, which would typically be realized as an ion Einzel lens arrangement. This, however, demands a fixed correlation of the ions' radial and axial momentum to keep them on track. Any breaking of this correlation e.g. due to collisions with residual gas atoms makes the ions swerve and lose track. These conditions are very common at relatively high pressure in the first stages of a multistage ion guide system, or in collision cells or drift cells, but can also occur due to space charge effects in later stages. To make an ion guide more resistant to such perturbations, systems of electrodes can be employed which are driven with radio frequency (RF) voltages having frequencies of about 0.5 to 5 MHz and amplitudes of some volts up to some 100 volts. When the amplitude and the frequency of the RF potential are properly chosen, ions will be effectively repelled from the RF electrodes by means of an effective potential or "pseudo-potential" which reflects the effect of the RF electric field on the ion averaged over a plurality of AC cycles. A repulsive force derivable from this pseudo-potential, the so-called "field gradient force", is proportional to the gradient of the square of the RF field strength, proportional to the square of the charge of the ion—and hence independent of its polarity—and inversely proportional to the ion mass and to the square of the RF frequency.

In most RF operated ion guide systems, adjacent electrodes are driven with sinusoidal voltages of opposite phase, i.e. with a phase shift of 180° in between. For example, in known multipole ion guides, four, six or eight rod electrodes may be arranged on a circle around and extending parallel to the ion path, thereby forming a quadrupole, hexapole or octopole structure, respectively.

While there are many purposes for ion guides in various fields of science and technology, and the present invention is not restricted to use in a specific one of them, the ion guide of the present invention is particularly suitable for use in ion beam deposition (IBD), mass spectroscopy (MS), such as triple quad, Orbitrap or quadrupole time-of-flight (Q-TOF) mass spectroscopy, in ion mobility spectroscopy (IMS) systems, and for use as an injection module to a quadrupole mass spectrometer, collision cell or ion trap. In IBD, ions are guided along an ion path through a series of pumping chambers with decreasing pressure prior to being deposited by means of so-called "soft landing" on a substrate or target. The purpose of the pumping chambers is to remove unwanted, neutral particles from the ion beam. Ion beam deposition has important advantages over conventional deposition techniques. For example, unlike sputtering, plasma spraying, physical vapor deposition (PVD) and atomic layer deposition (ALD), IBD is not restricted to the deposition of thermally stable molecules. Chemical vapor deposition (CVD) requires a chemical reaction between sometimes poisonous educts on the substrate, which can likewise be avoided using IBD. Finally, while spincoating is restricted to (on an atomic scale) large thicknesses, IBD allows for depositing layers of a defined atomic thickness.

Moreover, since an ion beam can be deflected using suitable electric fields, in IBD, it is possible to "write" structures on a substrate, in a way similar to mask free ion beam lithography. Accordingly, it is possible to position highly sensitive, thermolabile molecules with low masses, like amino acids up to molecules with high masses, like peptides, proteins or even DNA molecules with a layer thickness defined on an atomic scale in micro arrays for manufacturing assays, sensors or highly specific catalysts.

All of these advantages of IBD currently come at the price of a rather slow deposition speed, which is due to the limited yield of the IBD system in view of the comparatively low intensity of the ion beam in current IBD systems.

US 2014/037 45 89 discloses an ion guide comprising at least one multipole having a plurality of elongated electrodes carrying RF voltages. The electrodes can comprise wires or rods and can have square or flat instead of circular cross-sections, or the electrodes can have cross sections that vary along the allocated length.

GB 2 416 913 A discloses a centrifugal particle mass analyzer for removing particles from an aerosol except those close to a desired mass-to-charge ratio by holding the desired particles in a rotating flow between two electrodes between which an electric field exists, forming a classifier channel there between. Other particles strike the electrodes. The analyzer is constructed so that the electric field is not inversely proportional to the required centripetal acceleration of the particles, thereby providing a stable classification of the particles. The electrodes are supported on mounts which serve as sidewalls for the classifier channel. These mounts are manufactured from a material which allows a strong electric field to be imposed between the electrodes but which prevents the accumulation of static charges on the side walls, such as statically dissipative plastic with a resistivity between $10^9$ and $10^{12}$ Ohm·cm.

US 2017/350860 A1 discloses a trapped ion mobility spectrometer and proposes to use higher order (order N>2) linear multipole RF systems to accumulate and analyze ions at an electric DC field barrier, either pure higher order RF multipole systems or multipole RF systems with transitions from higher order towards lower order, e.g. from a linear octopolar RF system (N=4) to a linear quadrupole RF system (N=2) in front of the apex of the electric DC field barrier. An RF ion guide of the TIMS device is built by rolling or folding printed circuit boards (PCBs) carrying electrodes for generating radial RF fields and axial DC fields. The surface of the PCB is covered with a high-resistance coating to prevent charging up by ions, where the envisaged specific surface resistance is between $10^9$ to $10^{12}$ Ohms.

U.S. Pat. No. 4,885,500 discloses a quartz quadrupole comprising a quartz substrate, conductive strips and lower conductivity strips. The substrate includes hyperbolic inner surfaces which provide the geometry for the conformed conductive strips to produce an appropriate electric field for mass filter operation. The use of quartz as a substrate material is chosen to provide the thermal and electrical characteristics required by high-performance mass building operations. During such operation, potential field distortions by accumulated charge in cusp sections of the substrates are minimized by the low-conductivity strips, which are arranged to overlap longitudinal edges of the conductive strips.

SUMMARY OF THE INVENTION

The problem underlying the invention is to provide an ion guide which allows for increasing the yield of an IBD system, as well as an improved IBD system.

This problem is solved by an ion guide according to claim 1 as well as by an IBD system according to claim 26 and a method according to claim 27. Favorable embodiments are defined in the dependent claims.

The ion guide of the invention is suitable for guiding an ion beam along an ion path. The ion guide has a longitudinal axis corresponding to said ion path and comprises a plurality of elongate electrodes arranged around and extending along said longitudinal axis, wherein an inner envelope of the plurality of electrodes defines an ion guide volume.

According to the invention, the elongate electrodes are formed by electrode wires having a diameter of 1.0 mm or less, wherein adjacent electrode wires are arranged at an inter-wire distance. Moreover, the ion guide comprises holding structures for supporting and for straightening the electrode wires by applying a tension or maintaining a tension applied to them, wherein any portion of said holding structures which is separated from said ion guide volume by less than the local inter-wire distance, preferably by less than twice the local inter-wire distance, and most preferably by less than three times the local inter-wire distance is made from a material having a resistivity of less than $10^{12}$ Ohm·cm, preferably of less than $10^{9}$ Ohm·cm, or has a sheet resistivity of less than $10^{14}$ Ohm, preferably of less than $10^{10}$ Ohm on a surface facing said ion guide volume, preferably any surface facing said ion guide volume.

If the electrode wires are arranged on a circle around the longitudinal axis, the "inner envelope" at a given axial position would correspond to the largest circle that can be inscribed in the circular arrangement of the electrode wires. The radius of such a circle may be referred to as the "inscribed radius". FIG. 12 illustrates this with reference to a more general case, where a sectional view of an ion guide is shown with six electrode wires 42 arranged on an ellipse around the longitudinal axis. Note that the term "wire" not only stands for a wire with a circular cross section, any type of cross section like square or elliptic is possible. Adjacent electrode wires 42 are separated by inter-wire distances 122. Herein, the inner envelope is indicated by a dashed line 120, and the ion guide volume 128 is confined by this dashed line 120. In FIG. 12, 1st to 3rd multiples of the "local" inter-wire distance 122 are indicated, which may be used for measuring a "charging distance", i.e. the distance away from the ion guide volume 128. The term "charging distance" indicates that this distance is critical for the likelihood that isolators arranged at that distance are prone to being charged by stray ions. In the present case, the inter-wire distance 122 is uniform among the electrode wires 42, such that the local inter-wire distance 122 is the same as any single one of them. However, in case the distance should not be uniform, then the "local inter-wire distance" would relate to the individual inter-wire distances, which are related to a given axial position. If the electrodes are further parallel to the longitudinal axis, the ion guide volume 128 would correspond to the largest elliptical cylinder that fits into the arrangement of electrodes.

According to the invention, instead of using electrode rods, the ion guide of the present invention uses electrode wires, which are thinner than conventional rods, and in fact so thin that they need to be straightened by applying a tension to avoid bending. That is to say, without the straightening by means of applying a mechanical tension, the electrode wires would tend to bend due to the electrode wires' inherent bend (which wires typically acquire from being stored on a spool), temperature increase due to RF currents through the electrode wires, or ambient temperature changes, which may for example occur during bake-out of a vacuum system in which the ion guide may reside.

The inventors have discovered that with this design, the yield of an IBD system employing such an ion guide can be significantly increased. The yield of the IBD system is governed by the ion current that can be guided through the ion guide or ion guide arrangement, which is referred to as the "current capacity" of the ion guide (arrangement) herein. The obvious way to increase the current capacity would be to increase the diameter of the ion guide as a whole. However, when the diameter of the ion guide increases, the diameter of apertures in separation walls separating adjacent pumping chambers likewise need to be made correspondingly larger. This makes it more difficult to decrease the number of neutral particles in the ion beam by means of pumping. The flow of neutral particles in common with the ion beam is referred to as "gas load" in the following. In other words, the inventors noticed that when increasing the diameter of the apertures in the separation walls, eventually more pumping stages will be necessary to reduce the gas load to a desired degree. A larger number of pumping chambers however increases the manufacturing and operating costs and extends the ion path, leading to an inherent increase of ion losses.

Accordingly, the inventors realized that it is not possible to optimize the current capacity in a straightforward way by simply increasing the diameter of the ion guide. The inventors have found that, at a given ion guide diameter, the current capacity is increasing with increasing number of elongate electrodes. In addition, the inventors have found that optimum results can be achieved with a moderate diameter of the ion guide, but comparatively large numbers of elongate electrodes. Then, when also choosing optimum inter-wire distances, the inventors found that in favorable ion guides, the elongate electrodes should be made thinner than conventional rod electrodes, and in fact be formed by electrode wires which are so thin (and hence flexible) that they need tensioning to be kept straight. For this purpose, the ion guide of the present invention comprises the aforementioned holding structures for supporting and for straightening the electrode wires by applying a tension or maintaining a tension applied to them.

Moreover, the holding structures of the ion guide of the present invention are specifically designed such that any portion of the holding structures which is separated from the ion guide volume by less than the local inter-wire distance, preferably by less than twice the local inter-wire distance and most preferably by less than three times the local inter-wire distance is made from a material having a resistivity of less than $10^{12}$ Ohm·cm, preferably of less than $10^{9}$ Ohm·cm. This way, it can be avoided that the holding structures are charged by stray ions from the ion beam, which would lead to a distortion of the electric field for guiding the ion beam and in consequence to a reduction of the current capacity. A similar effect can be obtained if any portion of the holding structures which is separated from the ion guide volume by less than the local inter-wire distance, preferably by less than twice the local inter-wire distance and most preferably by less than three times the local inter-wire distance has a sheet resistivity of less than $10^{14}$ Ohm, preferably of less than $10^{10}$ Ohm on a surface facing said ion guide volume, preferably any surface facing said ion guide volume.

In a preferred embodiment, the number of electrode wires is 6 or more, preferably 8 or more, more preferably 10 more, and most preferably 16 or more. With higher numbers of electrode wires, the current capacity of the ion guide for a given diameter of the ion guide volume can be increased.

In preferred embodiments, a portion of said holding structures which is in contact with one of said electrode wires is made from an intermediate resistivity material having an electrical resistivity of between $10^2$ Ohm·cm and $10^{12}$ Ohm·cm, preferably of between $3 \cdot 10^5$ Ohm·cm and $10^9$ Ohm·cm. Those parts of the holding structures which are in physical contact with one of the electrode wires will mostly not be separated from the ion guide volume by more than the local inter-wire distance, since it is the inner envelope of the electrode wires that defines the ion guide volume. Accordingly, in the present invention, those parts of the holding structures that are actually in physical contact with the electrode wire must have a sufficiently low resistivity when too close to the inner envelope. When choosing an "intermediate resistivity", having an electrical resistivity of between $10^2$ Ohm·cm and $10^{12}$ Ohm·cm, preferably of between $3 \cdot 10^5$ Ohm·cm and $10^9$ Ohm·cm, the resistivity is sufficiently low to avoid inadvertent charging by stray ions, but is sufficiently high such that only moderate currents flow between electrode wires of opposite polarity which are in contact with the same holding structures. However, an appropriate draining of stray ions can also be achieved if a sheet resistivity on a surface facing said ion guide volume, preferably any surface facing the ion guide volume is between $10^4$ Ohm and $10^{14}$ Ohm, preferably between $3.10^7$ Ohm and $10^{10}$ Ohm. Such a surface resistivity can be obtained using the aforementioned intermediate resistivity materials, but can also be obtained by suitably coating a carrier with a coating of suitable conductivity, wherein the carrier may then e.g. be an electrical insulator.

In preferred embodiments, the intermediate resistivity material is a plastic material or a ceramic material including or mixed with conductive particles, in particular metal particles or graphite particles. Herein, the term "particle" shall have a broad meaning and not suggest any specific geometry. In particular, the term "particle" shall cover e.g. elongate particles having high aspect ratios, such as nanowires or the like. In addition or alternatively, ferrite based materials can be employed. It is important that the electrical resistivity of the intermediate resistivity material does not significantly change with temperature, or that the resistivity values fall within the above mentioned boundaries throughout the range of temperatures that the respective component may acquire during normal operation of the ion guide. Temperature changes are expected to occur due to heating of the wire electrodes caused by the RF currents, and since the ion guide is typically employed in a vacuum, there is no cooling by convection. For this reason, conventional semiconducting materials are not preferred as intermediate resistivity materials, because the resistance would tend to drop too much in the course of heating up during operation of the ion guide.

Instead of using the intermediate resistivity material, in some embodiments it is also possible to use arbitrary material that is coated at least on a surface facing said ion guide volume, preferably any surface facing said ion guide volume with a coating suitable for draining stray ions to thereby avoid static charging of said sealing elements by stray ions. Herein, said coating may be a metal film having a thickness of 30 to 1000 nm, or a paste containing glass and metal oxides, such as ruthenium oxide, wherein said paste preferably has a thickness of 5 to 1000 μm. This "paste" is also referred to as "cermet" in the art. A metal coating can be provided by evaporating or sputtering metal on a carrier, such as a carrier made from ceramic material.

In alternative embodiments, a portion of said holding structures which is in contact with one of said electrode wires is made from a conductive material, in particular from metal, wherein said portion of the holding structures is further attached to an insulating carrier, or to a carrier made from the aforementioned intermediate resistivity material. This way, inadvertent charging of said portion of the holding structures close to the electrode wires by stray ions can be reliably prevented, while a short circuit between portions of the holding structures in contact with electrode wires of different polarity can be avoided since they are attached to said insulating or intermediate resistivity material carrier. This insulating (or intermediate resistivity) carrier can be common to a plurality of portions of the holding structures which are in contact with electrode wires of different polarity.

In preferred embodiments, said holding structures comprise at least one electrode wire fixation structure in which the ends of the electrode wires are fixed, wherein in said electrode wire fixation structure, the electrode wires are bent by at least 90°, preferably by at least 120° and most preferably by at least 150°. This bending of the electrode wires allows for a secure fixation even in case of limited space. By bending the electrode wires by more than 90°, such as by 120° or more, or 150° or more, a pointed end structure of the ion guide can be obtained, which will be explained and illustrated further with reference to specific embodiments below. This pointed end structure is particularly suitable for guiding the ions into an adjacent component, such as another ion guide or a mass separator.

The electrode wires may be fixed to said electrode wire fixation structure by one or more of hard or soft soldering, spot welding, bonding, casting, clamping and fixation by a fastener, in particular a screw. While soft soldering provides a particularly simple way of fixing the electrode wires to the electrode wire fixation structure, this may be incompatible with very high vacuum requirements, for example due to zinc that is typically included in solder materials and has a comparatively high vapor pressure. In this case, fixation by clamping or by a fastener such as a screw would be preferred.

In preferred embodiments, said holding structures comprise a tensioning structure, suitable for establishing and/or maintaining a tension of the electrode wires. Herein, the tensioning structure may comprise one or more resilient elements, in particular one or more springs suitable for establishing and/or maintaining a tension of the electrode wires. The resilient element may absorb thermal expansion of the electrode wires, such as to keep the wires tensioned in spite of such thermal expansion. Examples for the resilient element may be a helical spring, a snap ring, or an extra elastic element. While in the preferred embodiments, the resilient element is incorporated in the holding structures or tensioning structure, it could also be incorporated into the electrode wires themselves.

In various embodiments, said holding structures comprise at least one electrode wire fixation structure which is movable along the longitudinal axis to thereby apply a tension to the electrode wires.

In preferred embodiments, said holding structures comprise at least one electrode wire guiding structure through which the electrode wires pass. In particular, the electrode wires may be bent while passing through the electrode wire guiding structure, thereby allowing for ion guide structures which are overall bent or curved, or which have varying diameters along their length.

In preferred embodiments, the electrode wires are, at least in a section of the ion guide, conically diverging from the longitudinal axis, wherein the opening angle of the conical structure is more than 0.1°, preferably more than 0.2° and most preferably more than 0.5°, and 90° or less, preferably 10° or less, more preferably 2° or less. Herein, the "opening angle" of a cone or frustum is the maximum angle between two generatrix lines. For example, a wide end of the conical ion guide structure may facilitate feeding an ion beam into said ion guide, and is less sensitive to slight misalignments of the ion guide with respect to an upstream component. At the same time, keeping the opening angle of the conical structure below 10°, and preferably below 2° allows for keeping a repulsive force due to the converging electrode wires in direction of travel within acceptable bounds. Even conical structures with very small opening angles below 1° can be useful, in particular for guiding the electrode wires by means of an electrode wire guiding structure radially constricting the electrode wires, to thereby obtain an hourglass shaped double cone structure with the electrode wire guiding structure defining the narrowest portion. This double cone or hourglass structure ensures a close contact of the electrode wires with the electrode wire guiding structure. It turns out that for this purpose, very small opening angles lower than 1° of the conical structure may be sufficient.

In preferred embodiments, the electrode wires are made from copper, molybdenum, tungsten, nickel, alloys or combinations thereof, or stainless steel. A particularly preferred electrode wire is made from copper with a silver coating.

In preferred embodiments, the electrode wires have a diameter of 0.6 mm or less, preferably of 0.2 mm or less. Such low electrode wire diameters allow for comparatively large numbers of electrode wires at comparatively small diameters of the ion guide volume.

Preferably, the ratio of the diameter of the electrode wire and the local inter-wire distance is between 0.5 and 10.0, preferably between 0.8 and 6.0, more preferably between 1.0 and 4.0. These ratios of electrode wire diameter and inter-wire distance have been found to be beneficial for a high current capacity of the ion guide. Higher numbers of said ratio, corresponding to lower local inter-wire distances, simplify the construction of the holding structure, as the charging distance is reduced. Using electrode wires, particularly electrode wires with diameters of less than 1.0 mm, or even less than 0.6 mm or 0.2 mm, these ratios can be achieved in spite of comparatively large numbers of elongate electrodes in combination with moderate ion guide diameters. In a preferred embodiment, the "inscribed radius" referred to above and explained with reference to FIG. 12 may be 5 mm or below, preferably 2 mm or below, and most preferably 1 mm or below, to thereby reduce the gas load.

In a preferred embodiment, at least some of the electrode wires are made from a material with an electrical DC resistance below 0.06 Ohm $mm^2/m$. A low resistance of the electrode wire material is important, as it allows for reducing the unwanted heating of the electrode wires by the RF currents. This becomes particularly important for small electrode wire diameters. With excessive heating of the electrode wires, it becomes more difficult to keep the electrode wires tensioned in view of the thermal expansion thereof. However, while such comparatively low electrical DC resistances are generally preferred, in alternative embodiments high electrode wire resistances are employed, such that at least some of the electrode wires are made from a material with an electrical DC resistance above 0.9 Ohm $mm^2/m$. High resistances allow for generating an electric field along the length of the electrode wire when a DC current flows through, which can be used for accelerating ions in longitudinal direction of the ion guide.

In particularly preferred embodiments, the material of the electrode wires has a skin depth at 1 MHz that is higher than 10 μm, more preferably higher than 20 μm and most preferably higher than 50 μm.

In preferred embodiments, said electrode wires are connected to an RF driving source configured to drive each adjacent two electrode wires with voltages of opposite polarity and freely adjustable radiofrequency. A freely adjustable driving frequency allows for choosing the optimum frequency for each type of ions to be guided in said ion guide. Preferably, said RF driving source is configured to drive the electrode wires with an RF square wave signal, or a superposition of RF square wave signals. A nonlimiting example of a "superposition of square wave signals" is a so-called "digital signal" which corresponds to a superposition of square waves with different amplitude and different duty cycle, but at the same base frequency.

Note that RF square wave driving signals or superpositions thereof are uncommon for conventional ion guides, where the electrodes are usually resonantly driven, using an LC circuit established by adding an inductive element and using the inherent capacitance of the electrodes for adjusting the resonance frequency. The inventors have noticed that the specific waveform (i.e. square wave digital waveform versus sinusoidal) has little bearing on the current capacity of the ion guide, but the square wave driving signal can be generated more easily with freely adjustable frequency than a sinusoidal driving signal. In fact, square wave signals can be generated by using switching circuits only, without having to provide for any resonant LC elements. Since the switching frequencies, the duty cycle and the superposition of square waves can be freely adjusted, the digital waveform or any other superposition of square waves can likewise be freely adjusted to thereby provide for optimum ion guiding performance.

In preferred embodiments, the electrode wires are connected to an RF driving source which supplies RF voltages having frequencies freely adjustable between about 0.05 to 20 MHz. In preferred embodiments, the RF driving source is connected with the electrode wires by leads that are as short as possible, such as to keep the capacity of the electrode wires low.

For applying a driving force on the ions in longitudinal direction of the ion guide, a DC electric field may be established along the longitudinal axis of the ion guide. In one embodiment, at least some of the electrode wires are segmented, having conductive portions separated by intermediate portions of lower conductivity, in particular insulating portions, and different DC voltages are applied to different conductive portions, to thereby generate an electric field along the length of the electrode wire, and hence along the longitudinal axis of the ion guide as a whole. Such longitudinal DC field may in particular be used to overcome a repulsive force generated by a conical structure of the ion guide.

In addition or alternatively, a DC potential gradient is established along the length of the electrode wires by means of a DC current through the respective electrode wire. This variant is particularly suitable for ion guides with very small inscribed radius and high length.

As was stated above, the ion guide of the invention may find practical use in many applications, and is not limited to any specific one of them. However, in particularly preferred embodiments, the ion guide according to one of the preceding embodiments is part of an arrangement, in which an ion beam is guided through at least two, but in general a plurality of pumping chambers of decreasing pressure, wherein adjacent pumping chambers are divided by separation walls having an aperture for the ion beam to pass through. An example of such an arrangement is an ion beam deposition system.

Herein, the ion guide preferably extends through at least one separation wall separating two adjacent pumping chambers. Namely, an ion guide according to one of the embodiments described above is particularly suitable for being accommodated in an aperture in a separation wall separating two adjacent pumping chambers, even if this aperture is of small size compared to designs of the state-of-the-art, which is advantageous for reducing the gas load. This way, the ion beam can be passed smoothly and with no or only insignificant loss from one pumping chamber into the other.

In particularly preferred embodiments, at least a portion of the ion guide (or the electrode wires thereof) is accommodated in a gas-tight tube, wherein each end of said gas-tight tube communicates with a corresponding one of the adjacent pumping chambers. This gas-tight tube allows for reducing the gas conductivity as compared to that of an ordinary aperture of same diameter, which in turn allows for significantly reducing the gas load. The inventors have found that if such gas-tight tube is employed such as to communicate with two adjacent pumping chambers, the overall pressure reduction in the second, downstream chamber is higher than without the gas-tight tube. Indeed, reductions of the gas load far above a factor of 1000 have been realized with a standard turbo pump in the vacuum chamber downstream, when using the gas-tight tube.

In a particularly preferred embodiment, said gas-tight tube forms part of the holding structures.

In a preferred embodiment, the diameter of the aperture in the separation wall through which said ion guide extends is 4.0 mm or less, preferably 3.0 mm or less, more preferably 2.0 mm or less.

A further aspect of the present invention relates to an ion beam deposition system, in which an ion beam is guided through a plurality of pumping chambers of decreasing pressure, wherein adjacent pumping chambers are separated by separation walls having an aperture for the ion beam to pass through, wherein said ion beam deposition system comprises an ion guide according to one of the embodiments described above.

A further aspect of the invention relates to a method of guiding an ion beam along an ion path using an ion guide having a longitudinal axis corresponding to said ion path, said ion guide comprising a plurality of elongate electrodes arranged around and extending along said longitudinal axis, wherein an inner envelope of the plurality of electrodes defines an ion guide volume, wherein said elongate electrodes are formed by electrode wires having a diameter of 1.0 mm or less and adjacent electrode wires are arranged at an inter-wire distance, wherein said ion guide comprises holding structures for supporting and for straightening the electrode wires by applying a tension or maintaining a tension applied to them, wherein any portion of said holding structures which is separated from said ion guide volume by less than the local inter-wire distance, preferably by less than twice the local inter-wire distance, and most preferably by less than three times the local inter-wire distance is made from a material having a resistivity of less than $10^{12}$ Ohm·cm, preferably of less than $10^{9}$ Ohm·cm or has a sheet resistivity of less than $10^{14}$ Ohm, preferably of less than $10^{10}$ Ohm on a surface facing said ion guide volume, preferably any surface facing said ion guide volume.

In a preferred embodiment, the method further comprises a step of driving each adjacent two electrode wires with RF voltages of opposite polarity, in particular with an RF square wave signal, wherein the method further comprises a step of adjusting the RF frequency and the voltage amplitude of the drive signal depending on the type of ions to be guided by said ion guide.

In the method, the ion guide may be an ion guide according to one of the embodiments recited above.

SHORT DESCRIPTION OF THE FIGURES

Figure 3:
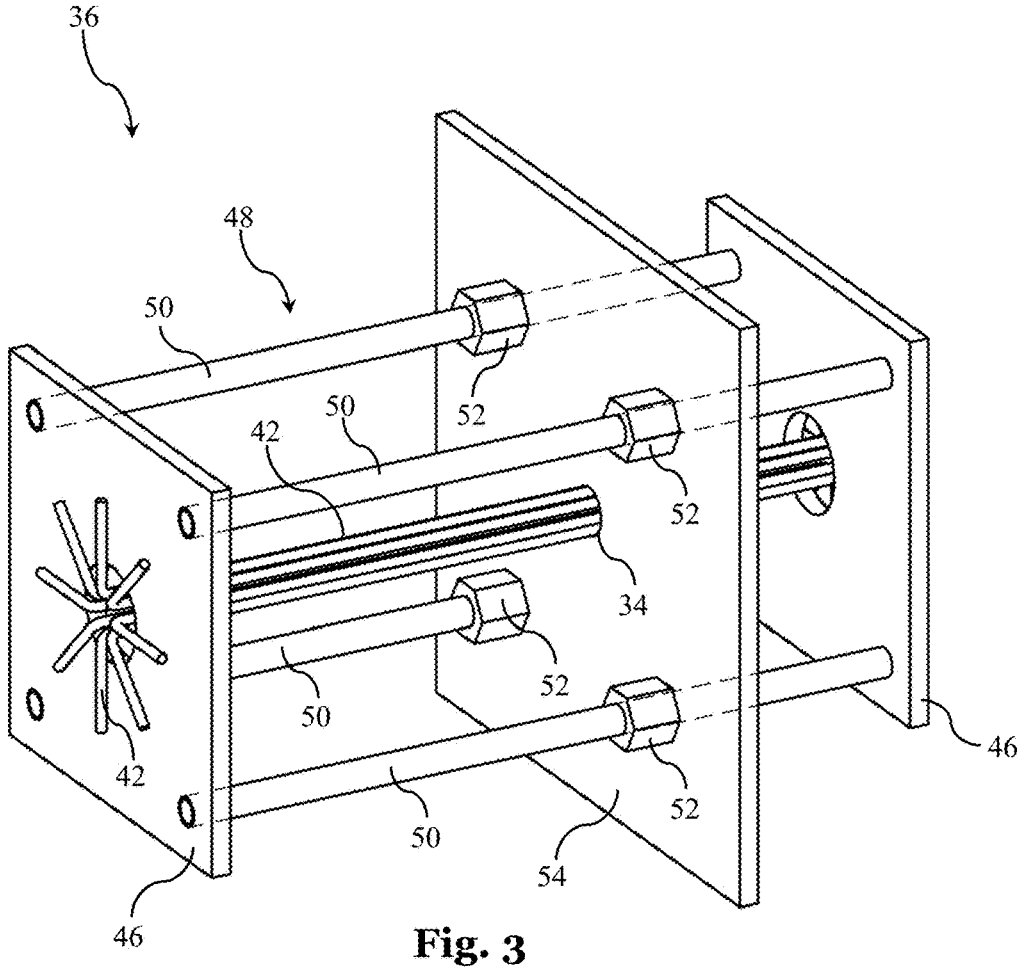
FIG. 3 is a perspective view of a WIG according to a second embodiment.
Figure 3A:
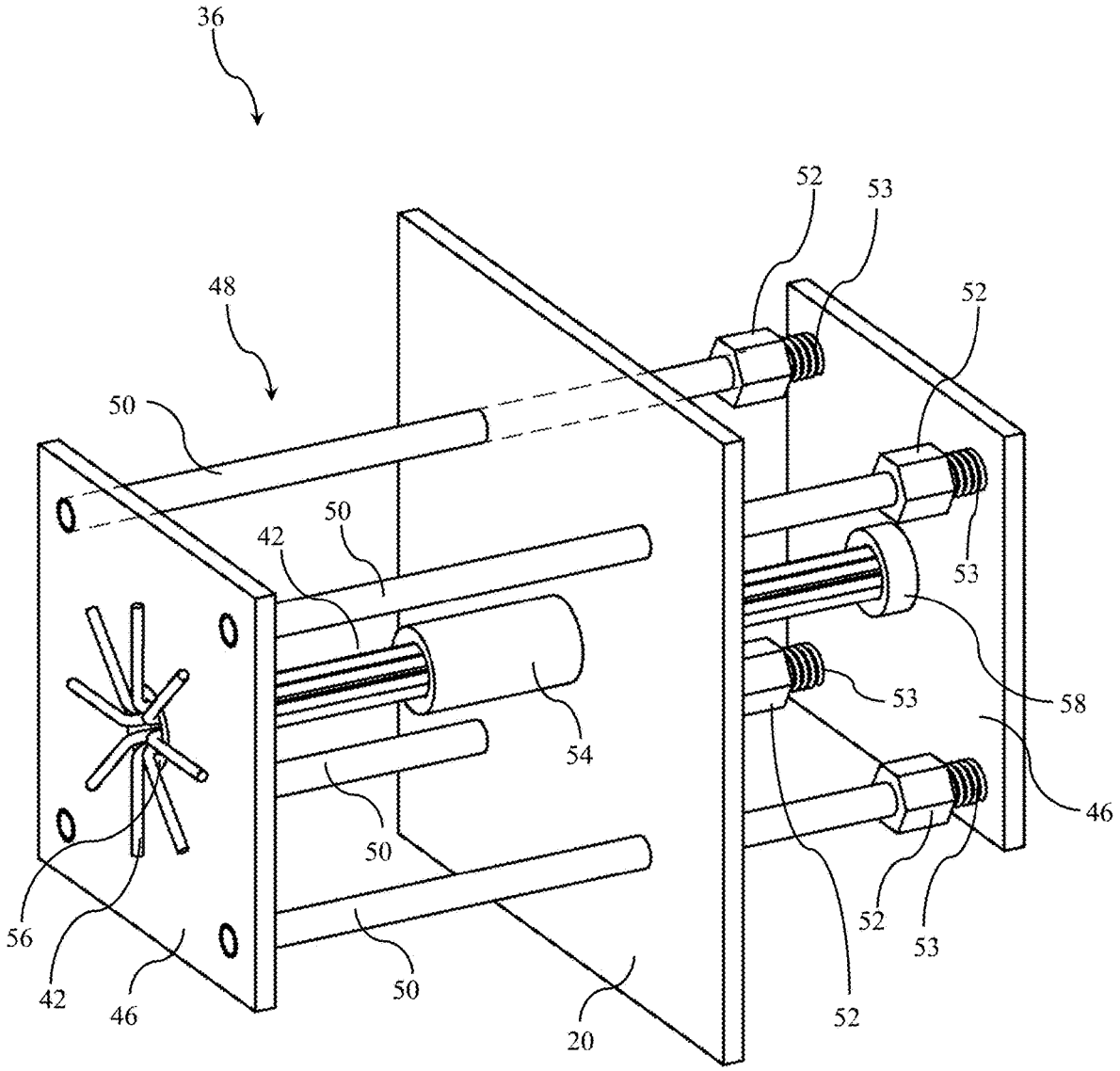

FIG. 3*a* is a perspective view of a slightly modified variant of the WIG of FIG. 3.

Figure 3B:
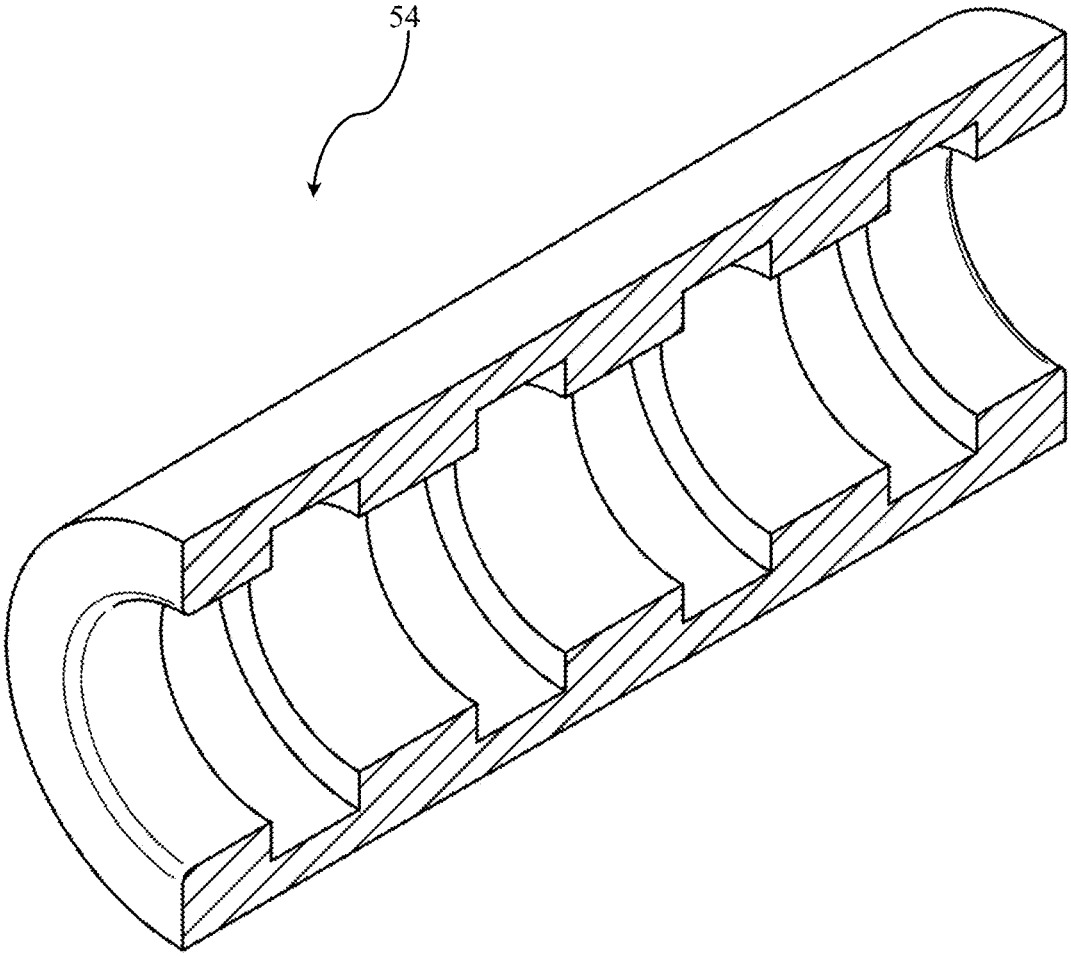

FIG. 3*b* is a perspective view of an electrode guiding structure acting as a special gas tight tube applicable to FIG. 3.

Figure 4:
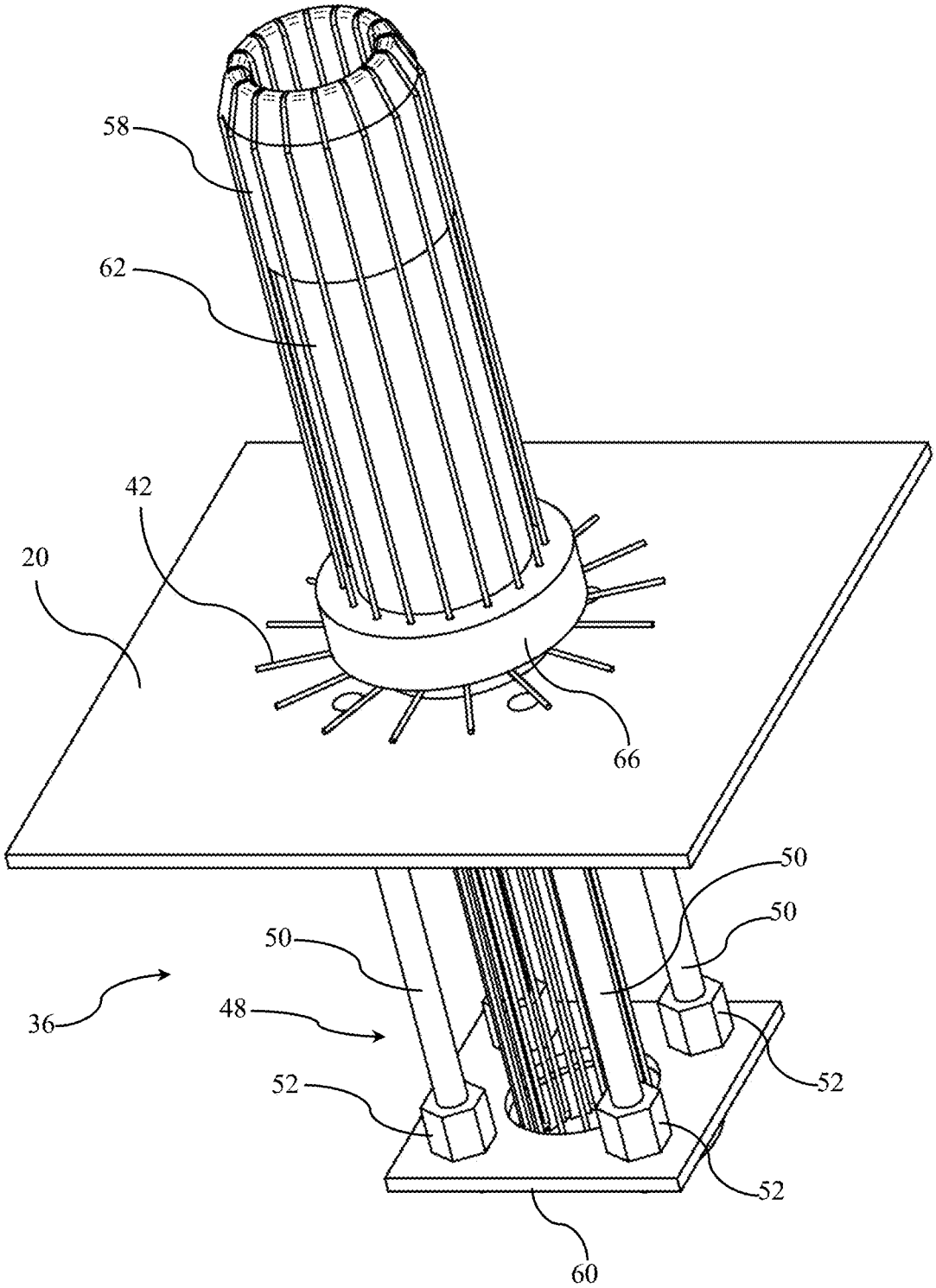

FIG. 4 is a perspective view of a WIG according to a third embodiment.

Figure 5:
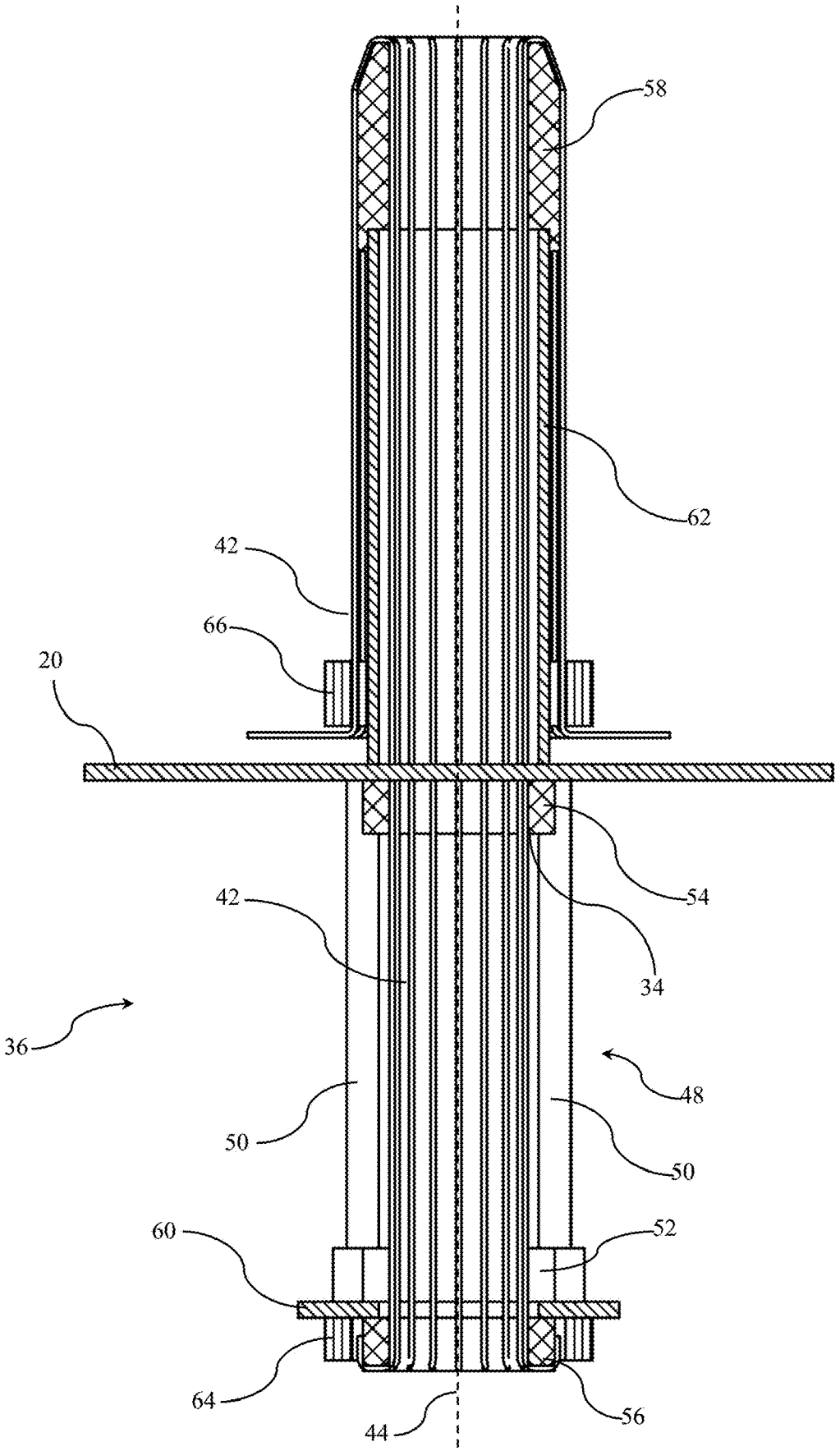

FIG. 5 is a sectional view of the WIG of FIG. 4.

Figure 6:
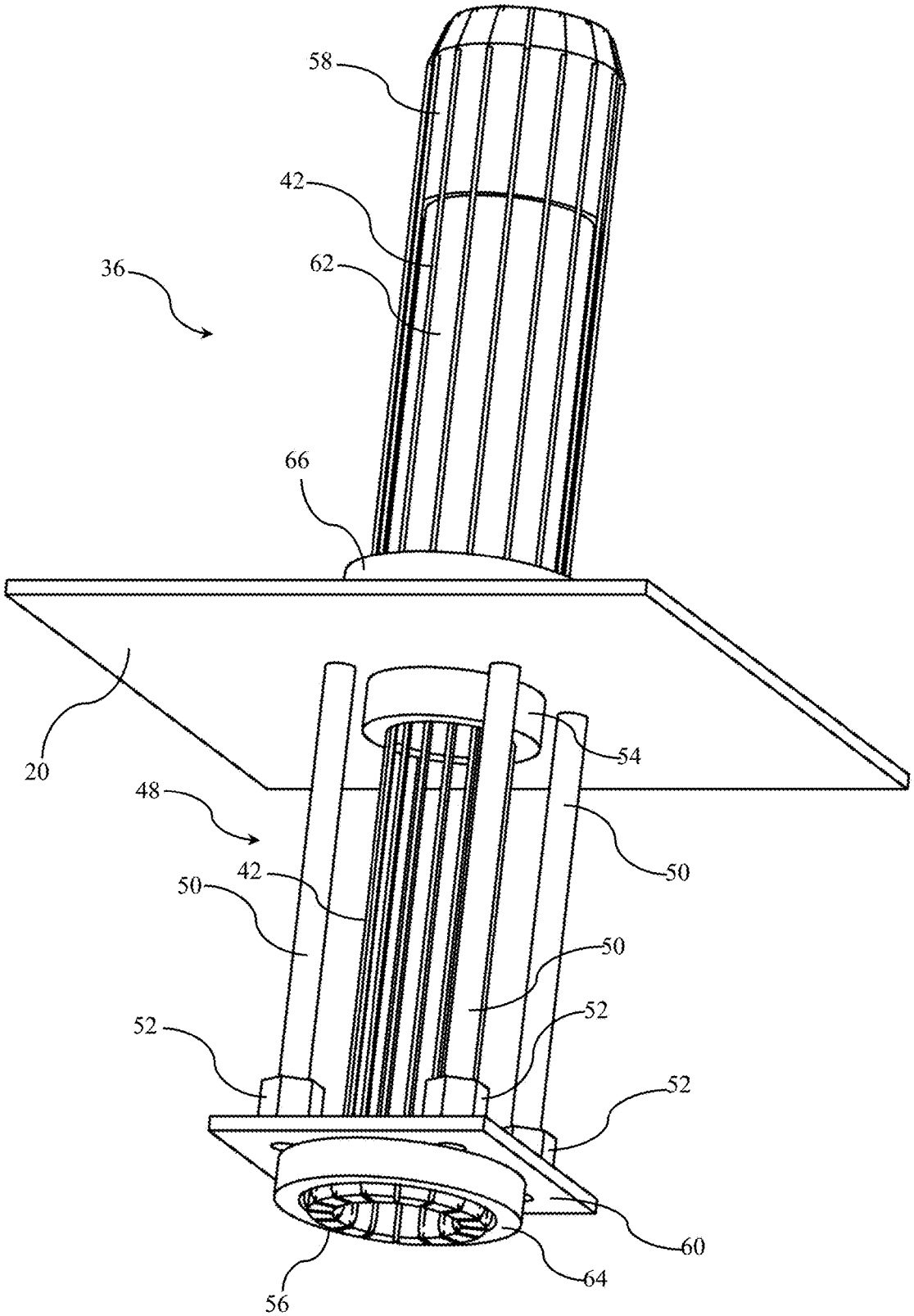

FIG. 6 is a perspective view of the WIG of FIG. 4.

Figure 7:
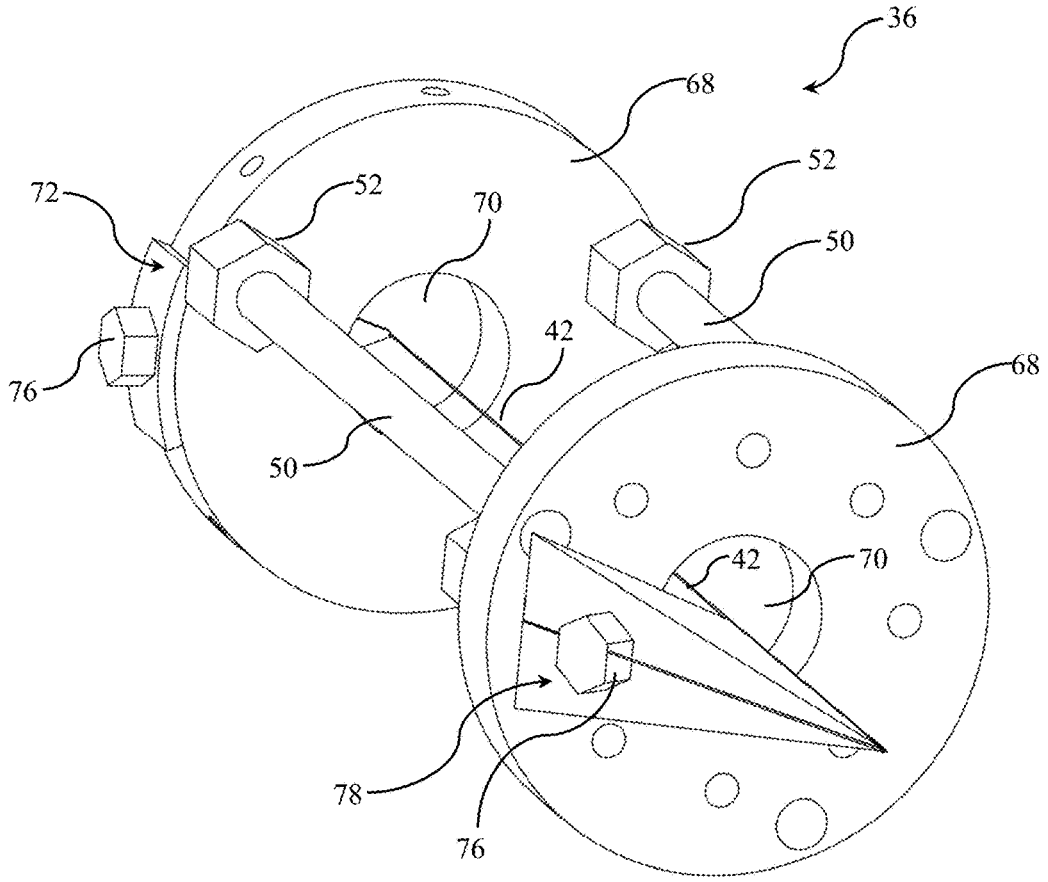

FIG. 7 is a perspective view of a WIG according to a fourth embodiment.

Figure 8:
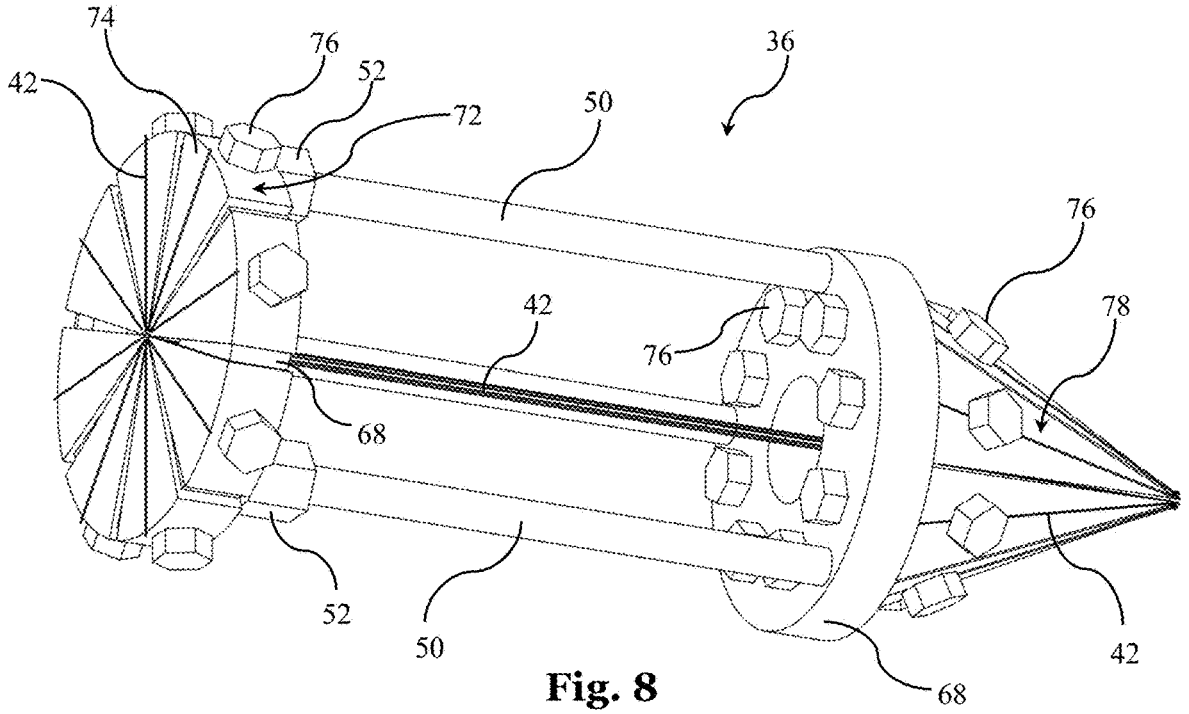

FIG. 8 is a further perspective view of the WIG of FIG. 7.

Figure 9:
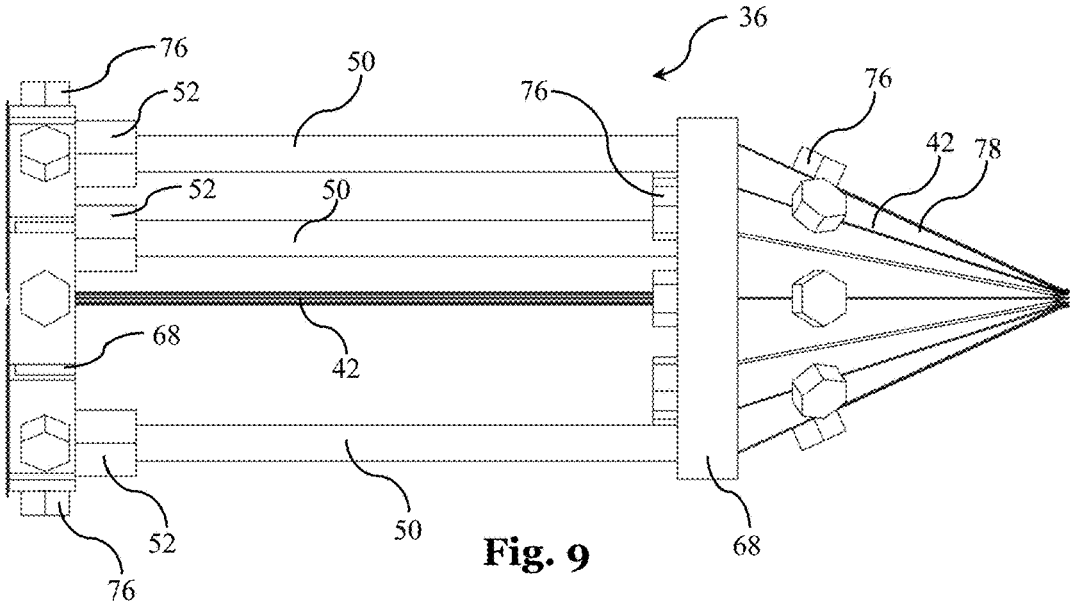

FIG. 9 is a side view of the WIG of FIG. 7.

Figure 10:
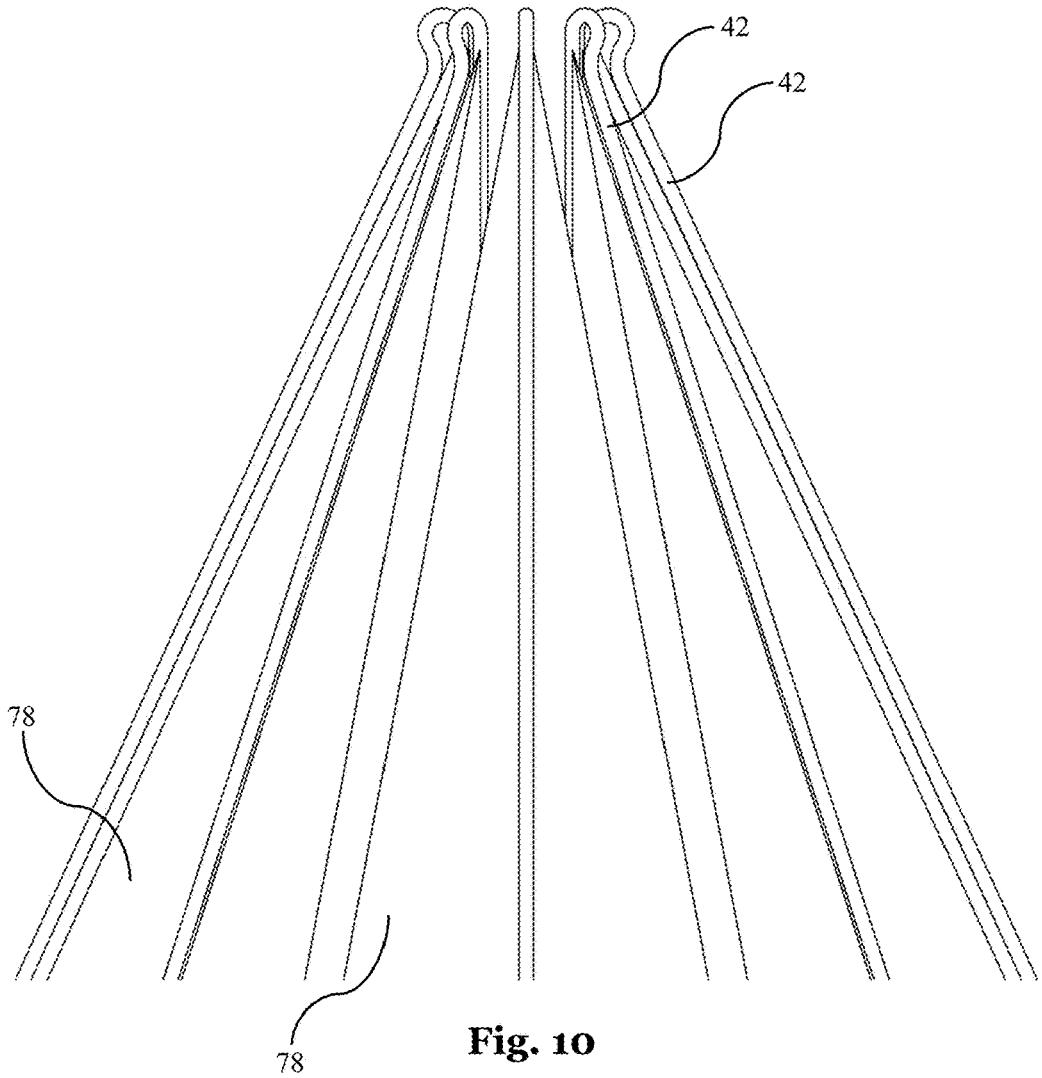

FIG. 10 is an enlarged view of the tip portion of the WIG of FIG. 7.

Figure 11:
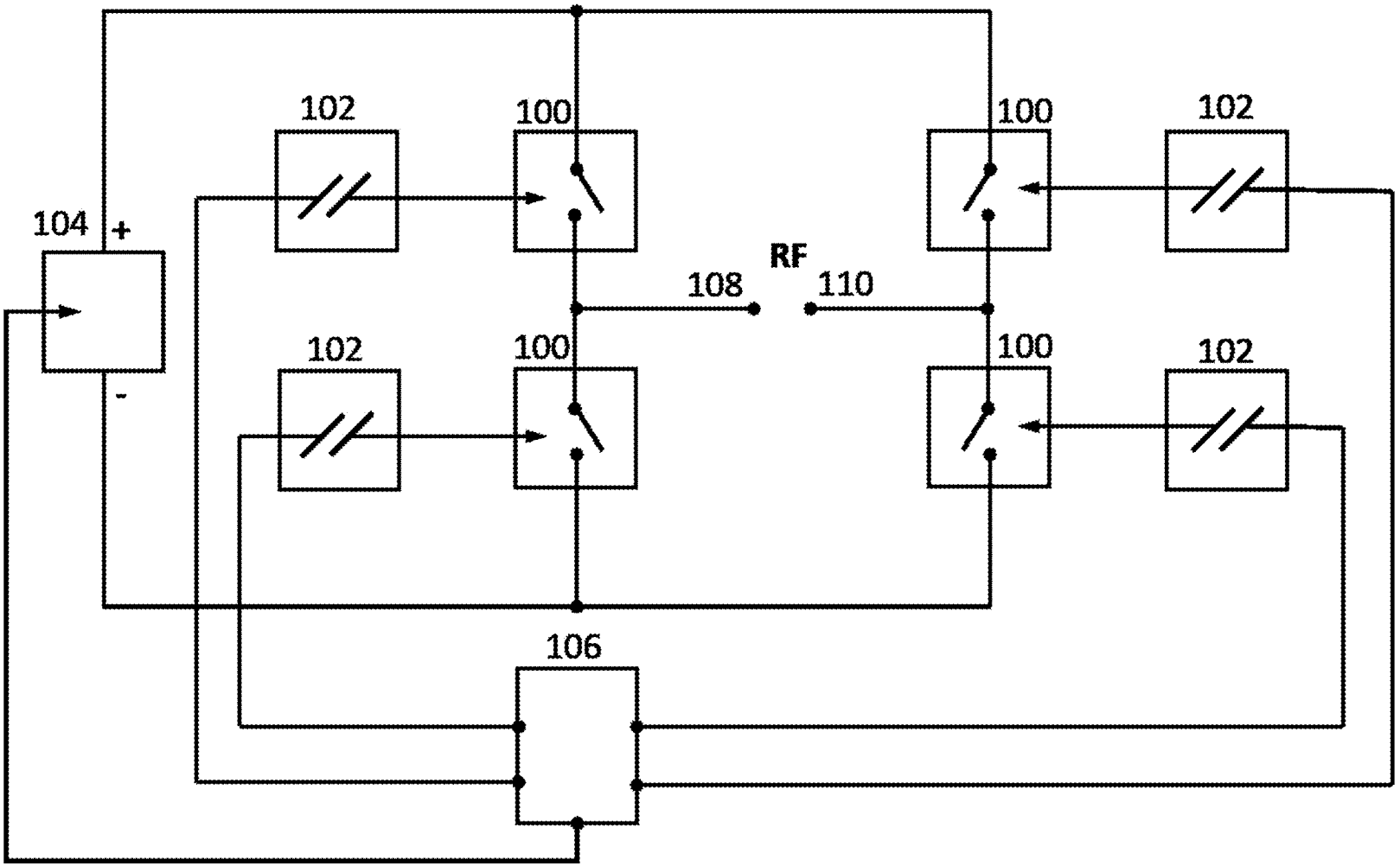

FIG. 11 is a circuit diagram showing a driving circuit for driving the electrode wires of a WIG according to various embodiments of the invention.

Figure 12:
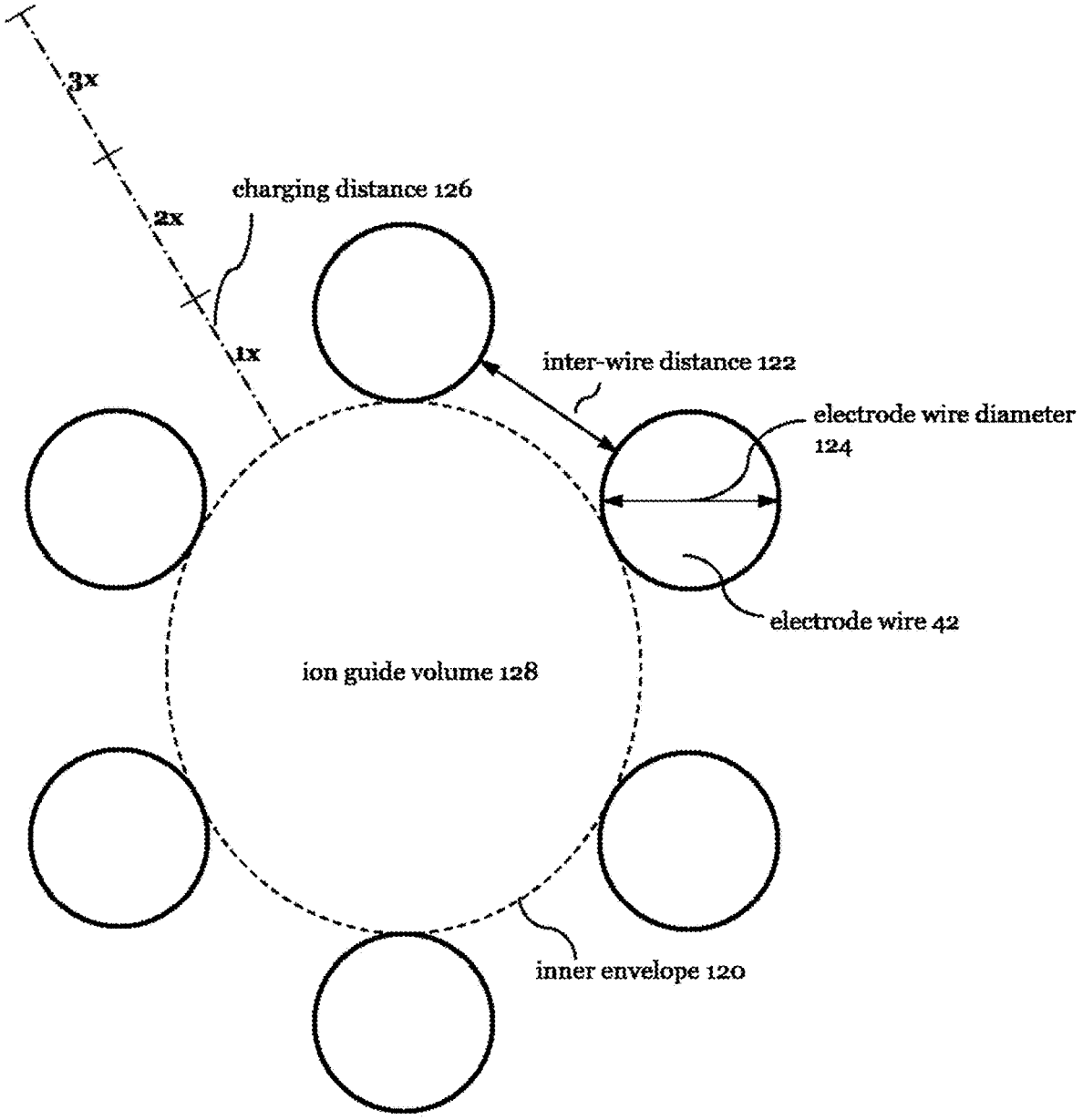

FIG. 12 is a schematic illustration of the inner envelope of electrodes defining an ion guide volume.

DESCRIPTION OF THE PREFERRED EMBODIMENTS

For the purposes of promoting an understanding of the principles of the invention, reference will now be made to preferred embodiments illustrated in the drawings, and specific language will be used to describe the same. It will nevertheless be understood that no limitation of the scope of the invention is thereby intended, such alterations and further modifications in the illustrated apparatus and such further applications of the principles of the invention as illustrated therein being contemplated as would normally occur now or in the future to one skilled in the art to which the invention relates.

Figure 1:
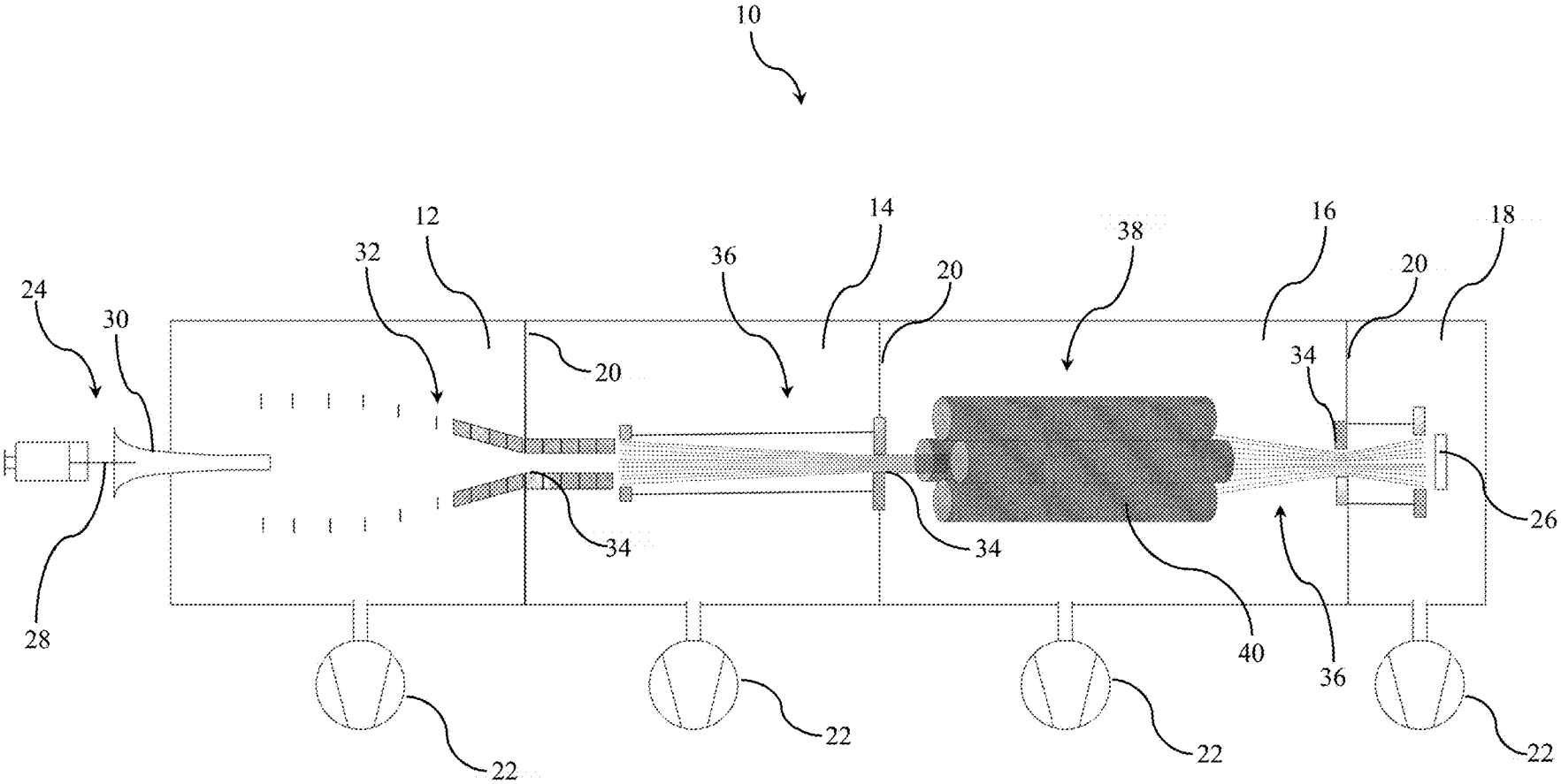
FIG. 1 is a schematic view of an ion beam deposition system employing two electrode wire based ion guides (WIG) according to embodiments of the present invention.

FIG. 1 shows a schematic illustration of an ion beam deposition (IBD) system 10. The IBD system 10 comprises first to fourth pumping chambers 12 to 18 separated by separation walls 20. Each of the pumping chambers 12 to 18 is connected with a corresponding vacuum pump 22. While all of the vacuum pumps are designated with the same reference sign 22, they may be of different types. On the left end of the IBD system 10, an electrospray ionization (ESI) device 24 is provided, in which molecules are ionized such as to generate the molecular ions to be used for eventual deposition on a substrate 26 located in the fourth chamber 18 at the very right of the figure. The ESI method has first been described in Malcolm Dole, L. L. Mack, R. L. Hines, R. C. Mobley, D. Furgeson, M. B Alice, *Molecular Beams of Macroions, J Chem Phys* 49 p. 2240 (1968). A noble prize had been awarded to John B. Feen for this method, see John B. Fenn, *Electrospray Wings for Molecular Elephants* (*Nobel Lecture*), *Angew Chem Int Ed* 42 p. 3871 (2003). In the ESI device 24, charged droplets of an electrolyte are drawn by a very high voltage from a needle 28 which is operated at atmospheric pressure. Each droplet includes, in addition to the charged molecules to be deposited, a large amount of unwanted solvent/carrier gas that needs to be removed by means of the pumps 22 connected to the succession of pumping chambers 12 to 18. The ions and the solvent/carrier gas are guided into the first pumping chamber 12 by means of a heated capillary 30.

The first pumping chamber 12 exhibits a pressure of between 0.1 and 10 mbar. For forming an ion beam, a combined ion funnel and tunnel device 32 is employed, which extends from the first pumping chamber 12 through an aperture in the separation wall 20 into the second pumping chamber 14. The combined ion funnel and tunnel device 32 is referred to as a TWIN guide 32 herein and are described in more detail in the co-pending patent application "Partly sealed ion guide and ion beam deposition system"

A first electrode wire based ion guide 36 according to an embodiment of the present invention is schematically shown, which extends from the second pumping chamber 14 through an opening in the separation wall 20 into the third pumping chamber 16. Wire based ion guides are referred to as a "wire ion guide" (WIG) herein for short. Herein, a portion of the WIG forms an aperture 34 through which neutral gas molecules can inadvertently pass from one chamber to the other, and that hence has an impact on the gas load, as explained above.

In the third pumping chamber 16, a quadrupole mass separator 38 is provided, which comprises four rod electrodes 40. Finally, a further WIG 36 is provided, which extends from the third pumping chamber 16 into the fourth pumping chamber 18 through an opening in the separation wall 20, and likewise defines an aperture 34. Note that the first and second WIGs 36 are only schematically shown in FIG. 1, where the wire electrodes and corresponding holding structures can be discerned, while the more detailed structure will be described in the following with reference to FIGS. 2 to 10.

Figure 2:
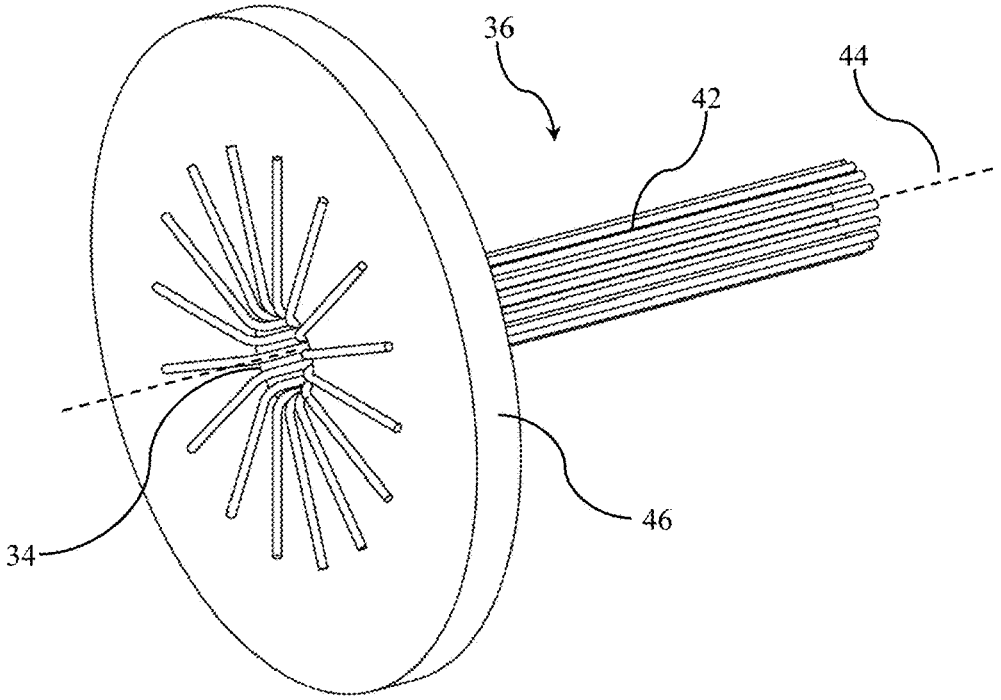
FIG. 2 is a perspective view of a portion of a WIG according to a first embodiment.

FIG. 2 shows a portion of an ion guide 36 according to a first embodiment, comprising a total of 16 electrode wires 42 which are extending parallel with each other and are arranged on a circle around a longitudinal axis 44. The inner envelope of the electrode wires 42 forms an ion guide volume in a manner illustrated in FIG. 12. The purpose of the ion guide 36 is to guide ions along the longitudinal axis 44 upon passing through the ion guide. Further schematically shown in FIG. 2 is an electrode wire fixation structure 46, which is a specific embodiment of the electrode wire holding structures referred to above. The electrode wire fixation structure 46 is made from an intermediate resistivity material having an electrical resistivity of $2 \cdot 10^6$ Ohm·cm, and is made from ferrite. This resistivity is low enough to avoid inadvertent charging due to scattered ions, but is at the same time sufficiently high to keep leakage current between adjacent electrode wires, which are driven with opposite phase, and hence opposite polarity, sufficiently low. Within the electrode wire fixation structure 46, an aperture 34 is formed. Herein the same reference sign 34 is used as for the aperture 34 in the separation walls 20 of FIG. 1, because in various embodiments, the fixation structure could be part of, or attached to the separation wall 20, in which case its size would govern the gas conductance, and thereby the gas load. In other words, in order to decrease the gas load, it is advantageous if the aperture 34 is as small as possible. Since the intermediate conductivity material can be brought in direct contact with the electrode wires 42, the aperture 34 can be made extremely small, while at the same time avoiding excessive leakage currents between neighboring electrode wires 42 and the risk of inadvertent charging by stray ions.

As is further seen in FIG. 2, the electrode wires 42 are bent by 90° in the electrode wire fixation structure 46. The bent ends of the electrode wires 42 can then be fixed to the electrode wire fixation structure 46 by soldering, spot welding, bonding, casting, clamping, and/or fixation by means of a fastener, such as a screw (not shown in FIG. 2).

A second embodiment of a WIG 36 is schematically shown in FIG. 3. The WIG 36 of FIG. 3 comprises a tensioning structure 48, which comprises two electrode wire fixation structures 46 connected by extendable rods 50, which can be extended by operating corresponding control elements 52. In the example shown, the control elements 52 are hexagonal screw drive elements which upon turning allow for adjusting the length of each rod 50, to thereby move the electrode wire fixation structures 46 away from each other and apply an appropriate tension to the electrode wires 42. In between the electrode wire fixation structures 46, an electrode wire guiding structure 54 is provided, which again comprises an aperture 34. In various embodiments, the wire guiding structure 54 could be part of, or attached to the separation wall 20 between adjacent pumping chambers. In the embodiment shown, the electrode wire guiding structure 54 is made from an intermediate resistivity material, thereby allowing it to be in direct contact with the electrode wires 42, facilitating the guiding of the electrode wires 42 and keeping the aperture 34 to a minimum size.

FIG. 3*a* shows a closely related variant of the WIG of FIG. 3, comprising springs 53 arranged between the hexagonal screw drive elements 52 and one of the fixation structures 46, which force the two fixation structures 46 apart from each other to thereby maintain a tension among the electrode wires 42. The springs 53 are an example of the resilient members or elements mentioned in the summary of the invention, and they permit to maintain mechanical tension of the electrode wires 42 in spite of a certain degree of expansion thereof. In this embodiment the separation wall 20 and the electrode wire guiding structure 54 are distinct elements as mentioned before. Furthermore the annular holding elements 56 and 58 are inserted into the fixation structures 46. Thus the fixation structures 46 and the separation wall 20 itself can be made of simple metal, whereas the electrode wire guiding structure 54, and annular holding elements 56 and 58 have intermediate resistivity. In the present embodiment the electrode wire guiding structure 54 additionally acts as a gas-tight tube to be described later. A partially sectional view of the wire guiding structure 54 is shown in FIG. 3*b*.

A third embodiment of a WIG 36 is shown in FIGS. 4 to 6. FIGS. 4 and 6 show two perspective views and FIG. 5 shows a sectional view of the third embodiment. The WIG 36 of the third embodiment comprises 16 electrode wires 42 arranged parallel to and on a circle around a longitudinal axis 44 (see FIG. 5). In FIGS. 4 to 6, the diameter of the electrode wires 42 is shown not to scale, for sake of clarity of the figures. In the actual embodiment, the thickness of the electrode wires 42 would be larger than shown, and in fact such that the thickness and the inter-wire distance are about the same or the thickness is higher. The WIG 36 of the third embodiment comprises a first annular holding element 56 and a second annular holding element 58 at its respective ends. Each of the first and second annular holding elements 56, 58 and the electrode wire guiding structure 54 is in direct contact with the electrode wires 42, and is made from an intermediate resistivity material of the type described above. Of the plurality of electrode wires 42, only exemplary ones are designated with reference signs for clarity purposes in the figures. The first annular holding element 56 is attached to a metal plate 60, which is in turn connected to a separation wall part 20 separating two pumping chambers by means of extendable rods 50 in a similar way as was shown in FIG. 3. By operating screw drive elements 52, the distance between the metal plate 6*o* and the separation wall 20 can be changed, and the tension of the electrode wires 42 can be adjusted. In an alternative embodiment (not shown), a spring-loaded variant of the type shown in FIG. 3*a* may be employed. The metal plate 60, the separation wall 20, and the extendable rods 50 hence form an embodiment of a tensioning structure.

As is seen in FIG. 5 and FIG. 6, the electrode wires 42 are guided through a ring like aperture plate 58 attached to a larger opening within the separation wall 20, which is very close to the electrode wires 42, and which is consequently made from an intermediate resistivity material. The aperture plate 58 and the electrode wire guiding structure 54 hence define the aperture 34 of the separation wall 20, and in fact keeps it at a minimum, to thereby reduce the gas load. Since the opening in the separation wall 20 itself is larger, and its edge hence is sufficiently far away from the electrode wires 42, the separation wall 20 can be made from metal, as is the case in the embodiment shown. It is to be understood that the separation wall indicated at reference sign 20 in FIGS. 4 to 6 could be a part of the separation wall separating adjacent pumping chambers only. However, in a modified variant, the aperture 34 and the electrode wire guiding structure 54 could be narrower than shown, such that it radially constricts the electrode wires 42 and leads to a double cone, hourglass like shape (not shown).

On the right of the separation wall 20, a gas-tight tube 62 is shown, which extends between the separation wall 20 and the second annular holding element 58. The tube 62 is sufficiently far away from the inner volume of the WIG 36, such that it is not prone to being hit and possibly charged by stray ions, and it is not in direct physical contact with the electrode wires 42 either. For this reason, there are no particular requirements for the resistivity of the material of the gas tight tube 62. In the embodiment shown, it is made from metal, because it can be manufactured easily and with high precision. The gas-tight tube 62 reduces the gas conductivity through the aperture 34 and the aperture plate 58, hence helps to reduce the gas load. In FIGS. 3 and 3*a*, representing the second embodiment, the task of the gas-tight tube 62 is taken over by the electrode guiding structure 54. FIG. 3*b* shows a sectional view of the electrode guiding structure 54 acting as a special gas-tight tube 62. The notches inside the electrode guiding structure 54 are interrupting the smooth flow of the neutral gas, leading to turbulences which reduce the gas flow between two adjacent pumping chambers and in consequence reduce the gas load.

Finally, first and second annular fixation elements 64 and 66 are provided for fixing the respective ends of the electrode wires 42.

The second annular holding element 58 can be regarded as part of a fixation structure that also involves the second annular fixation element 66. The annular holding element 58 has a conical end around which the electrode wires 42 are bent prior to fixation by the annular fixation element 66, to thereby provide a slim, pointed end of the ion guide 36. This pointed end is advantageous for feeding ions exiting at the right end of the WIG 36 of the third embodiment as shown in FIGS. 4 to 6 into a downstream component, such as a further WIG 36, or a mass separator such as the quadrupole mass separator 38 shown in FIG. 1. Accordingly, the third embodiment WIG 36 could be ideally used to guide ions through the separation wall 20 between the second and third pumping chambers 14, 16 shown in FIG. 1 and into the quadrupole mass separator 38.

As is apparent from both, the summary of the invention and the description of FIGS. 2 to 6, the term "holding structures" generally denotes structures that are used for supporting and for straightening the electrode wires 42 by applying a tension or maintaining a tension applied to them. Such "holding structures" may comprise various substructures, such as fixation structures, which specifically serve to fix the electrode wires 42 to a part of the holding structures (e.g. the fixation structure 46 shown in FIG. 2 or 3), tensioning structures, which serve to apply a tension to the electrode wires 42 (such as the tensioning structure 48 shown in FIG. 3 to FIG. 6), or electrode wire guiding structures, which serve to guide the electrode wires and reduce the gas load, such as the electrode wire guiding structure 54 of FIGS. 3 to 6. Since the fixation structures, tensioning structures or electrode wire guiding structures are essentially functional subunits of the holding structures, there may be overlaps between the subunits, or in other words, some components may be part of several of them. For example, the fixation structures 46 of FIG. 3 are part of the tensioning structure 48 and so on.

Finally, with reference to FIGS. 7 to 10, a WIG 36 according to a fourth embodiment is shown. The fourth embodiment differs from the first to third embodiments in that no intermediate resistivity material is employed. Instead, those parts of the holding structures which are in direct contact with the electrode wires 42 are made from metal, and are further attached to a carrier with intermediate resistivity or a common insulating carrier 68.

More particularly, the WIG 36 according to the fourth embodiment comprises two annular insulating carriers 68 which are separated by three extendable rods 50, the length of which can again be adjusted by operation of hexagonal screw drive elements 52 for adjusting the tension of the electrode wires 42. Although not shown, the extendable rods 50 could also be biased in an extended configuration by means of a spring similar to the spring 53 shown in FIG. 3*a*. The electrode wires 42 extend through comparatively large openings 70 (cf. FIG. 7) within the annular insulating carriers 68, the edge of which being sufficiently far away from the inner volume of the WIG 36 such that there is no risk that the insulating carriers 68 are hit and thereby charged by stray ions.

For each of the electrode wires 42, a metal element for fixing the respective end of the electrode wire 42 is provided, which is in direct contact with the respective electrode wire 42, and which is fixed to a corresponding insulating carrier 68. The individual metal elements are not in contact with each other, such as to avoid a short circuit between electrode wires 42 of different polarity.

More particularly, on the left end of the of the WIG 36 as shown in FIGS. 8 and 9, which is preferably the upstream end, eight first metal elements 72 are provided which have a flat surface 74 to which a respective end of the corresponding electrode wire 42 is attached. The first metal elements 72 are fixed to the same annular insulating carrier 68 by means of screws 76. Accordingly, the insulating carrier 68, the first metal elements 72 and the screws 76 in combination form a fixation structure.

At the right end of the WIG 36 as shown in FIGS. 8 and 9, which is the downstream end, eight second metal elements 78 are attached to the corresponding annular insulating carrier 68 by means of screws 76. The second metal elements 78 have the shape of a right-angled pyramid with a triangular base, which triangular base is attached to the insulating annular carrier 68 by means of a screw 76 (see FIG. 8). The electrode wires 42 are guided along the vertical edge of the pyramid and bent around its apex as can be seen best in FIG. 10. While not shown in the figures, a notch or the like is provided in the apex region to facilitate the guiding of the electrode wire 42. The electrode wires 42 are then attached to an outward pointing face of the second metal element 78 by means of a further screw 76. Using the pyramid shaped second metal elements 78, again a pointed end of the WIG 36 can be obtained, which facilitates the injection of ions exiting or the receiving of ions at the right end in FIGS. 8 and 9, which is preferably the downstream end, into a downstream structure, such as a mass separator of the type shown under reference sign 38 in FIG. 1. For clarity, in FIG. 7, only a single first metal element 72 and a single second metal element 78 with a corresponding electrode wire 42 are shown. Again, the annular insulating carrier 68, the second metal elements 78 and the screws 76 in combination form a fixation structure.

In operation, high-frequency AC voltages are applied to the electrode wires 42 with frequencies on the order of 0.05-20 MHz and amplitudes of some 0.1-100 V. For clarity of illustration, the corresponding high-frequency driving source is omitted in FIGS. 1 to 10. An example of a suitable driving source is shown in FIG. 11. The driving source comprises a DC voltage source 104, four switches 100 and a control unit 106 for controlling the switching states of the switches 100. Between the switches 100 and the control unit 106, potential separating elements 102 are provided. The RF output voltage is supplied at terminals 108 and no. The control unit 106 controls the switches 100 to alternate between two switching states, a first switching state, in which the upper left and the lower right switch 100 are closed and the remaining switches 100 are open, and a second, opposite state, where the lower left and the upper right switch 100 are closed, and the remaining switches 100 are open. In the first switching state, the RF terminal 108 has positive voltage and the RF terminal 110 has negative voltage, while in the second switching state, the voltages are reversed. Accordingly, by alternating between the first and second switching states, under the control of the control unit 106, a square wave RF output voltage at the terminals 108, 110 is provided. Moreover, under the control of the control unit 106, the output RF frequency can be freely adjusted.

While in first to fourth embodiment shown with reference to FIGS. 2 to 10 the electrode wires 42 are arranged parallel to each other and to the longitudinal axis 44 of the WIG 36, in various embodiments, the electrode wires 42 could diverge from the longitudinal axis 44 in a conical manner, as is shown in FIG. 1, although in an exaggerated manner for illustration purposes. In preferred embodiments, the opening angle of the conical structure should be limited to 90° or less, preferably to 10° or less, and most preferably to 2° or less. The WIG 36 could also have a conical and a cylindrical portion, or two conical portions with different orientations such as to yield an hourglass shape, as is the case for the WIG 36 extending through the third and fourth pumping chambers 16 and 18 in FIG. 1. For obtaining such structures, it is advantageous to employ guiding structures 54 through which the electrode wires 42 pass, wherein the electrode wires 42 are bent while passing through the guiding structure. In particular, it is advantageous to fabricate such guiding structures, which are in direct contact with the electrode wires 42 and close to the inner volume of the WIG 36, from an intermediate resistivity material.

While it is the primary purpose of the ion guide 36 to confine the ions within a region close to the longitudinal axis 44, in some embodiments it is also desired to apply an electric field in longitudinal direction, in order to accelerate the ions, or to overcome a repulsive potential caused by electrode wires 42 which are conically converging in downstream direction. In some embodiments, the electrode wires 42 are therefore segmented, having conductive portions separated by intermediate portions of lower conductivity, in particular insulating portions. Then, in addition to the RF voltages, different DC voltages can be applied to different conductive portions to thereby generate an electric field along the length of the electrode wire 42, and correspondingly along the length of the WIG 36 as a whole. Instead of using segmented electrode wires, it is likewise possible that at least some of the electrode wires 42 have an electrical resistance of 0.9 Ohm $mm^2/m$ or more. Then, a DC potential gradient may be established along the length of the electrode wire 42 by applying a DC current through the respective electrode wire 42.

The WIG 36 according to the embodiments shown above finds particularly favorable use in ion beam deposition (IBD) systems 10 of the type shown in FIG. 1, because they allow for establishing an unprecedented favorable compromise between high current capacity and low gas yield. Indeed, using WIG devices 36 according to embodiments of the present invention, it becomes possible to provide an IBD system 10 which allows to reduce the pressure by at least 11, and even up to 13 orders of magnitude (i.e. from atmospheric pressure to $10^{-11}$ bar, or even $10^{-13}$ bar) with only four pumping chambers 12, 14, 16 and 18. Depending on the demanded final pressure, even fewer pumping chambers could be used.

Although a preferred exemplary embodiment is shown and specified in detail in the drawings and the preceding specification, these should be viewed as purely exemplary and not as limiting the invention. It is noted in this regard that only the preferred exemplary embodiment is shown and specified, and all variations and modifications should be protected that presently or in the future lie within the scope of protection of the invention as defined in the claims.

What is claimed is:

1. An ion guide for guiding an ion beam along an ion path, said ion guide having a longitudinal axis corresponding to said ion path, said ion guide comprising a plurality of elongate electrodes arranged around and extending along said longitudinal axis, wherein an inner envelope of the plurality of electrodes defines an ion guide volume, characterized in that said elongate electrodes are formed by electrode wires having a diameter of 1.0 mm or less, wherein adjacent electrode wires are arranged at an inter-wire distance, wherein said ion guide comprises holding structures for supporting and for straightening the electrode wires by applying a tension or maintaining a tension applied to the electrode wires, wherein any portion of said holding structures which is separated from said ion guide volume by less than the local inter-wire distance is made from a material having a resistivity of less than $10^{12}$ Ohm·cm or has a sheet resistivity of less than $10^{14}$ Ohm on a surface facing said ion guide volume.

2. The ion guide of claim 1, wherein the number of electrode wires is 6 or more.

3. The ion guide of claim 1, wherein a portion of said holding structures which is in contact with one of said electrode wires is made from an intermediate resistivity material having an electrical resistivity of between $10^2$ Ohm·cm and $10^{12}$ Ohm·cm or has a sheet resistivity of between $10^4$ Ohm and $10^{14}$ Ohm on a surface facing said ion guide volume.

4. The ion guide of claim 3, wherein the intermediate resistivity material is a plastic material or a ceramic material including or mixed with conductive particles, or a ferrite based material, or wherein said sheet resistivity is obtained by coating a surface of said holding structures which is in contact with one of said electrode wires with a metal film having a thickness of 30 to 1000 nm, or with a paste containing glass and metal oxides, wherein said paste has a thickness of 5 to 1000 μm.

5. The ion guide of claim 1, wherein a portion of said holding structures which is in contact with one of said electrode wires is made from a conductive material, wherein said portion of the holding structures is further attached to an insulating carrier, or to a carrier made from said intermediate resistivity material.

6. The ion guide of claim 1, wherein said holding structures comprise at least one electrode wire fixation structure in which the ends of the electrode wires are fixed, wherein in said electrode wire fixation structure, the electrode wires are bent by at least 90°.

7. The ion guide of claim 6, wherein the electrode wires are fixed to said electrode wire fixation structure by one or more of hard or soft soldering, spot welding, bonding, casting, clamping and fixation by a fastener, in particular a screw.

8. The ion guide of claim 1, wherein said holding structures comprise a tensioning structure, suitable for establishing and/or maintaining a tension of the electrode wires, wherein said tensioning structure comprises one or more resilient elements, suitable for establishing and/or maintaining a tension of the electrode wires.

9. The ion guide of claim 1, wherein said holding structures comprise at least one electrode wire guiding structure through which the electrode wires pass.

10. The ion guide of claim 1 wherein the electrode wires are, at least in a section of the ion guide, conically diverging from the longitudinal axis, wherein the opening angle of the conical structure is more than 0.2°, and 90° or less.

11. The ion guide of claim 1, wherein the electrode wires have a diameter of 0.6 mm or less.

12. The ion guide of claim 1, wherein the ratio of the diameter of the electrode wire and the local inter-wire distance is between 0.8 and 6.0.

13. The ion guide of claim 1, wherein said electrode wires are connected to an RF driving source configured to drive adjacent two electrode wires with voltages of opposite polarity and freely adjustable radiofrequency, wherein said RF driving source is configured to drive the electrode wires with an RF square wave signal, or a superposition of RF square wave signals.

14. The ion guide of claim 1, wherein the ion guide extends through at least one separation wall separating two adjacent pumping chambers.

15. The ion guide of claim 14, wherein at least a portion of the ion guide is accommodated in a gas-tight tube, wherein each end of said gas-tight tube communicates with a corresponding one of the adjacent pumping chambers.

16. The ion guide of claim 1, wherein said ion guide is part of an ion beam deposition system, in which an ion beam is guided through a plurality of pumping chambers of decreasing pressure, wherein adjacent pumping chambers are separated by separation walls having an aperture for the ion beam to pass through.

17. A method of guiding an ion beam along an ion path using an ion guide having a longitudinal axis corresponding to said ion path, said ion guide comprising a plurality of elongate electrodes arranged around and extending along said longitudinal axis, wherein an inner envelope of the plurality of electrodes defines an ion guide volume, wherein said elongate electrodes are formed by electrode wires having a diameter of 1.0 mm or less, wherein adjacent electrode wires are arranged at an inter-wire distance, wherein said ion guide comprises holding structures for supporting and for straightening the electrode wires by applying a tension or maintaining a tension applied to the electrode wires, wherein any portion of said holding structures which is separated from said ion guide volume by less than the local inter-wire distance is made from a material having a resistivity of less than $10^{12}$ Ohm·cm or has a sheet resistivity of less than $10^{14}$ Ohm on a surface facing said ion guide volume, said method further comprises a step of driving each adjacent two electrode wires with RF voltage, to thereby guide said ion beam along said ion path.

18. The method of claim 17, further comprising a step of driving each adjacent two electrode wires with RF voltages of opposite polarity, wherein the method further comprises a step of adjusting the RF frequency and the voltage amplitude of the drive signal depending on the type of ions to be guided by said ion guide.

* * * * *